US008808475B2

(12) United States Patent
Gehrmann et al.

(10) Patent No.: US 8,808,475 B2
(45) Date of Patent: Aug. 19, 2014

(54) IRON-NICKEL ALLOY

(75) Inventors: Bodo Gehrmann, Plettenberg (DE); Bernd Boer, Altena (DE)

(73) Assignee: Outokumpu VDM GmbH, Werdohl (DE)

( * ) Notice: Subject to any disclaimer, the term of this patent is extended or adjusted under 35 U.S.C. 154(b) by 600 days.

(21) Appl. No.: 12/223,130

(22) PCT Filed: Jan. 26, 2007

(86) PCT No.: PCT/DE2007/000141
§ 371 (c)(1),
(2), (4) Date: Sep. 11, 2008

(87) PCT Pub. No.: WO2007/087785
PCT Pub. Date: Aug. 9, 2007

(65) Prior Publication Data

US 2009/0047167 A1 Feb. 19, 2009

(30) Foreign Application Priority Data

Feb. 2, 2006 (DE) ..... 10 2006 005 250

(51) Int. Cl.
*C21D 8/02* (2006.01)
*C22C 38/08* (2006.01)
*C22C 38/10* (2006.01)

(52) U.S. Cl.
USPC ..... 148/579; 148/336; 420/95

(58) Field of Classification Search
USPC ..... 420/85, 89, 94, 95, 103, 581; 148/336, 148/442, 579
See application file for complete search history.

(56) References Cited

U.S. PATENT DOCUMENTS

| | | | |
|---|---|---|---|
| 3,514,284 | A | 5/1970 | Eiselstein |
| 3,971,677 | A | 7/1976 | Mason et al. |
| 5,425,912 | A | 6/1995 | Smith et al. |
| 5,688,471 | A | 11/1997 | Smith et al. |
| 6,420,054 | B1 | 7/2002 | Cozar et al. |
| 6,605,163 | B2 | 8/2003 | Cozar et al. |
| 2002/0008456 | A1 | 1/2002 | Cozar et al. |

FOREIGN PATENT DOCUMENTS

| | | |
|---|---|---|
| CN | 1357056 | 7/2002 |
| CN | 1367268 | 9/2002 |
| DE | 1558714 | 4/1970 |
| DE | 2 421 680 | 11/1974 |
| DE | 199 34 400 | 2/2001 |
| DE | 199 34 401 | 3/2001 |
| DE | 601 00 966 | 7/2004 |
| EP | 1 063 304 | 12/2000 |
| EP | 1 138 797 | 10/2001 |
| EP | 1 156 126 | 11/2001 |
| FR | 2 855 185 | 11/2004 |
| GB | 912828 | 12/1962 |
| GB | 1401259 | 7/1975 |
| JP | 55-054548 | 4/1980 |
| JP | 2-298236 | 12/1990 |
| JP | 4-180542 | 6/1992 |
| JP | 10-310845 | 11/1998 |
| JP | 11-293413 | 10/1999 |
| JP | 2003-505594 | 2/2003 |
| WO | WO-01/07673 | 2/2001 |

OTHER PUBLICATIONS

"A Word About Invar", Special Metals Corporation, 2001, p. 2-11.*
J. R. Davis; "Nickel, Cobalt, and their alloys", 2000, ASM International, Ohio, XP002434631, p. 352.
John A. Schey; "Composites"; Introduction to Manufacturing Processes, Composites; pp. 593-615, 2000.

* cited by examiner

*Primary Examiner* — Roy King
*Assistant Examiner* — Caitlin Kiechle
(74) *Attorney, Agent, or Firm* — Jordan and Hamburg LLP

(57) ABSTRACT

Disclosed is a creep-resistant low-expansion iron-nickel alloy that is provided with increased mechanical resistance and contains 40 to 43 wt. % of Ni, a maximum of 0.1 wt. % of C, 2.0 to 3.5 wt. % of Ti, 0.1 to 1.5 wt. % of Al, 0.1 to 1.0 wt. % of Nb, 0.005 to 0.8 wt. % of Mn, 0.005 to 0.6 wt. % of Si, a maximum of 0.5 wt. % of Co, the remainder being composed of Fe and production-related impurities. Said alloy has a mean coefficient of thermal expansion <5×10<–6>/K in the temperature range of 20 to 200 DEG C.

14 Claims, 3 Drawing Sheets

IRON-NICKEL ALLOY

BACKGROUND OF THE INVENTION

The invention relates to a creep-resistant and low-expansion iron-nickel alloy that has increased mechanical strength.

Increasingly, components are being produced from carbon fiber-reinforced composites (CFC), even those for products with security considerations, such as in aircraft manufacture. For producing such components, large-format linings are needed for tool molds, low-expansion iron-nickel alloys having about 36% nickel (Ni36) being fabricated to date.

Although the alloys used to date do have a thermal expansion coefficient that is less than $2.0\times10^{-6}$/K, their mechanical properties are considered inadequate.

Known from U.S. Pat. No. 5,688,471 is a high strength alloy having an expansion coefficient of max. $4.9\times10^{-6}$ m/m/° C. at 204° C. that comprises (in percent by weight) 40.5 to 48% Ni, 2 to 3.7% Nb, 0.75 to 2% Ti, max. 3.7% total content of Nb+Ta, 0 to 1% Al, 0 to 0.1% C, 0 to 1% Mn, 0 to 1% Si, 0 to 1% Cu, 0 to 1% Cr, 0 to 5% Co, 0 to 0.01% B, 0 to 2% W, 0 to 2% V, 0 to 0.01 total content of Mg+Ca+Ce, 0 to 0.5% Y and rare earths, 0 to 0.1% 5, 0 to 0.1% P, 0 to 0.1% N, and remainder iron and minor impurities. It should be possible to use the alloy for producing molds for composite materials that have low expansion coefficients, e.g. for carbon fiber composites or for producing electronic strips, curable lead frames, and masks for monitor tubes.

A high-strength low-expansion alloy with the following composition (in percent by weight) can be taken from JP-A 04180542: ≤0.2% C, ≤2.0% Si, ≤2.0% Mn, 35-50% Ni, 12% Cr, 0.2-1.0% Al, 0.5-2.0% Ti, 2.0-6.0% Nb, remainder iron. When necessary, the following additional elements can be provided:

≤0.02% B and/or ≤0.2% Zr. The alloy can be used inter alia for metal molds for precision glass sheet production.

In addition to a low thermal expansion coefficient, mold engineers involved in aircraft manufacture also desire an improved alloy that has greater mechanical strength compared to Ni36.

SUMMARY OF THE INVENTION

The underlying object of the invention is therefore to provide a novel alloy that, in addition to a low thermal expansion coefficient, should also have greater mechanical strength than the Ni36 alloys previously used.

This object is attained using a creep-resistant and low-expansion iron-nickel alloy that has higher mechanical strength, with (in percent by weight):

| | |
|---|---|
| Ni | 40 to 43% |
| C | max. 0.1% |
| Ti | 2.0 to 3.5% |
| Al | 0.1 to 1.5% |
| Nb | 0.1 to 1.0% |
| Mn | 0.005 to 0.8% |
| Si | 0.005 to 0.6% |
| Co | max. 0.5% |

remainder Fe and constituents resulting from the production process, that has a mean thermal expansion coefficient of $<5\times10^{-6}$/K in the temperature range from 20 to 200° C. Further, a method is provided that comprises fabricating a mold from materials comprising a creep-resistant and low-expansion iron-nickel alloy that has increased mechanical strength and producing an object of carbon fiber-reinforced composite in the mold from the alloy set forth above.

In a more specific aspect, a method is provided wherein the above-described alloy comprises wire and the fabricating of the mold comprises welding with the wire comprised of the alloy.

In an alternative specific aspect, a method is provided wherein the above-described alloy is in the form of forged stock. In yet another alternative specific aspect, a method is provided wherein the above-described alloy is in the form of cast stock.

This object is alternatively also attained using a creep-resistant and low-expansion iron-nickel alloy that has higher mechanical strength with (in percent by weight):

| | |
|---|---|
| Ni | 37 to 41% |
| C | max. 0.1% |
| Ti | 2.0 to 3.5% |
| Al | 0.1 to 1.5% |
| Nb | 0.1 to 1.0% |
| Mn | 0.005 to 0.8% |
| Si | 0.005 to 0.6% |
| Co | 2.5 to 5.5% |

remainder Fe and constituents resulting from the production process, that satisfies the following condition:

Ni+½ Co>38 to <43.5%, the alloy having a mean thermal expansion coefficient of $<4\times10^{-6}$/K in the temperature range from 20 to 200° C. Further, a method is provided that comprises fabricating a mold from materials comprising a creep-resistant and low-expansion iron-nickel alloy that has increased mechanical strength and producing an object of carbon fiber-reinforced composite in the mold from the alloy set forth above.

Advantageous refinements of the alternative alloy, one cobalt-free and one containing cobalt, are also provided in the present invention.

The inventive alloy can be provided for similar applications, in one instance cobalt-free and in another with the addition of defined cobalt contents. Alloys with cobalt are distinguished by even lower thermal expansion coefficients, but suffer from the disadvantage that they are associated with a higher cost factor compared to cobalt-free alloys.

Compared to alloys based on Ni 36 that were used in the past, with the inventive subject-matter it is possible to satisfy the desires of the mold engineer, in particular in aircraft manufacture, for a thermal expansion coefficient that is low enough for applications and that also has higher mechanical strength.

If the alloy is to be cobalt-free; according to a further idea of the invention it has the following composition (in percent by weight):

| | |
|---|---|
| Ni | 40.5 to 42% |
| C | 0.001 to 0.05% |
| Ti | 2.0 to 3.0% |
| Al | 0.1 to 0.8% |
| Nb | 0.1 to 0.6% |
| Mn | 0.005 to 0.1% |
| Si | 0.005 to 0.1% |
| Co | max. 0.1% |

remainder Fe and constituents resulting from the production process, that has a thermal expansion coefficient of $<4.5\times10^{-6}$/K in the temperature range from 20 to 200° C.

Depending on the application, for attaining thermal expansion coefficients of $<4.0\times10^{-6}$/K, in particular $<3.5\times10^{-6}$/K, the contents of the aforesaid alloy element can be further limited in terms of their contents. Such an alloy is distinguished by the following composition (in percent by weight):

| | |
|---|---|
| Ni | 41 to 42% |
| C | 0.001 to 0.02% |
| Ti | 2.0 to 2.5% |
| Al | 0.1 to 0.45% |
| Nb | 0.1 to 0.45% |
| Mn | 0.005 to 0.05% |
| Si | 0.005 to 0.05% |
| Co | max. 0.05% |

remainder Fe and constituents resulting from the production process.

The following table provides the accompanying elements, which are actually not desired, and their maximum content (in percent by weight):

| | |
|---|---|
| Cr | max. 0.1% |
| Mo | max. 0.1% |
| Cu | max. 0.1% |
| Mg | max. 0.005% |
| B | max. 0.005% |
| N | max. 0.006% |
| O | max. 0.003% |
| S | max. 0.005% |
| P | max. 0.008% |
| Ca | max. 0.005%. |

If an alloy with cobalt is used for mold construction, according to another idea of the invention it can be comprised as follows (in percent by weight):

| | |
|---|---|
| Ni | 37.5 to 40.5% |
| C | max. 0.1% |
| Ti | 2.0 to 3.0% |
| Al | 0.1 to 0.8% |
| Nb | 0.1 to 0.6% |
| Mn | 0.005 to 0.1% |
| Si | 0.005 to 0.1% |
| Co | >3.5 to <5.5% |

remainder Fe and constituents resulting from the production process,
that satisfies the condition $$Ni+\tfrac{1}{2}Co>38 \text{ to } <43\%,$$

and that has a mean thermal expansion coefficient of $<3.5\times10^{-6}$/K in the temperature range from 20 to 200° C.

Another inventive alloy has the following composition (in percent by weight):

| | |
|---|---|
| Ni | 38.0 to 39.5% |
| C | 0.001 to 0.05% |
| Ti | 2.0 to 3.0% |
| Al | 0.1 to 0.8% |
| Nb | 0.1 to 0.6% |
| Mn | 0.005 to 0.1% |
| Si | 0.005 to 0.1% |
| Co | <4 to <5.5% |

remainder Fe and constituents resulting from the production process,
that satisfies the condition $$Ni+\tfrac{1}{2}Co>38.5 \text{ to } <43\%,$$

and that has a mean thermal expansion coefficient of $<3.5\times10^{-6}$/K in the temperature range from 20 to 200° C.

For special applications, in particular for reducing the thermal expansion coefficient in ranges of $<3.2\times10^{-6}$/K, in particular $<3.0\times10^{-6}$/K, the content of individual elements can be further limited as follows (in percent by weight):

| | |
|---|---|
| Ni | 38.0 to 39.0% |
| C | 0.001 to 0.02% |
| Ti | 2.0 to 2.5% |
| Al | 0.1 to 0.45% |
| Nb | 0.1 to 0.45% |
| Mn | 0.005 to 0.05% |
| Si | 0.005 to 0.5% |
| Co | <4 to <5.5% |

remainder Fe and constituents resulting from the production process,
that satisfies the following condition:

$$Ni+\tfrac{1}{2}Co>40 \text{ to } <42\%.$$

For the cobalt-containing alloys, the accompanying elements should not exceed the following maximum contents (in percent by weight):

| | |
|---|---|
| Cr | max. 0.1% |
| Mo | max. 0.1% |
| Cu | max. 0.1% |
| Mg | max. 0.005% |
| B | max. 0.005% |
| N | max. 0.006% |
| O | max. 0.003% |
| S | max. 0.005% |
| P | max. 0.008% |
| Ca | max. 0.005%. |

Both the cobalt-free alloy and the cobalt-containing alloy should preferably be used in CFC mold construction, specifically in the form of sheet material, strip material, or tube material.

Also conceivable is using the alloy as wire, in particular as an added welding substance, for joining the semi-finished products that form the mold.

It is particularly advantageous that the inventive alloy can be used as a mold component for producing CFC aircraft parts such as for instance wings, fuselages, or tail units.

It is also conceivable to use the alloy only for those parts of the mold that are subject to high mechanical loads. The less loaded parts are then embodied in an alloy that has a thermal expansion coefficient that matches that of the inventive material.

The molds are advantageously produced as milled parts from heat-formed (forged or rolled) or cast mass material and then are annealed as needed.

In the following, preferred inventive alloys are compared, in terms of their mechanical properties, to an alloy according to the prior art.

DETAILED DESCRIPTION OF THE INVENTION

Figure 1:
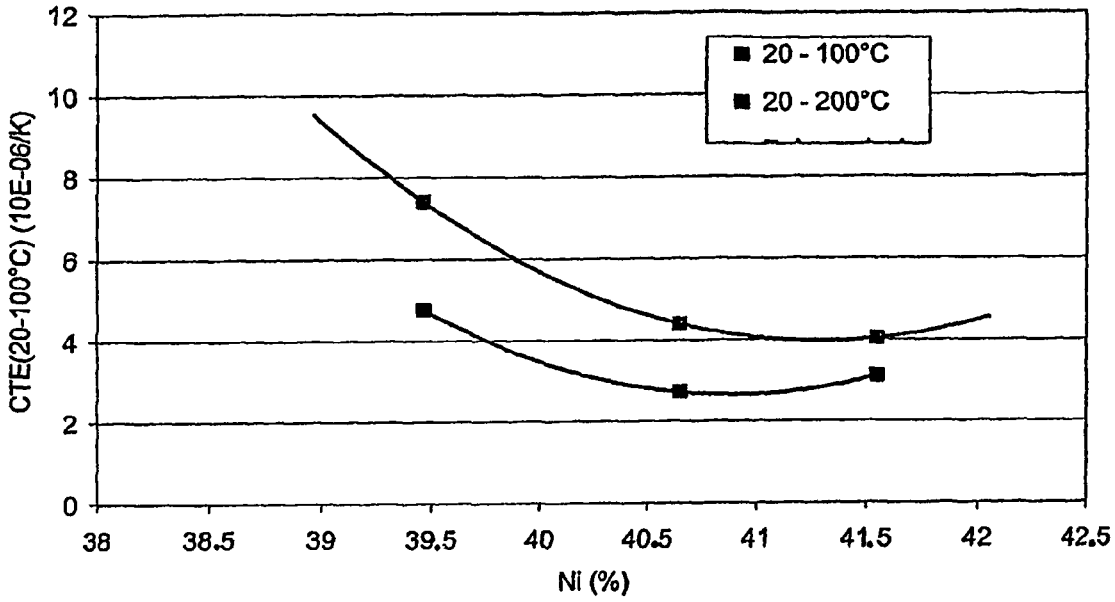
FIGS. 1 to 3 are graphs showing expansion coefficients as a function of Ni Content.

The following Table 1 provides the chemical composition of two investigated cobalt-free laboratory melts compared to two Pernifer 36 alloys that belong to the prior art.

TABLE 1

| Element | Alloy | | | |
|---|---|---|---|---|
| | Pernifer 36 MoSo2 | Pernifer 36 | Pernifer 40 Ti HS | Pernifer 41 Ti HS |
| | LB batch | | | |
| (%) | 151292 | 50576 | 1018 | 1019 |
| Cr | 0.20% | 0.03 | 0.01 | 0.01 |
| Ni | 36.31 | 36.07 | 40.65 | 41.55 |
| Mn | 0.12 | 0.31 | 0.01 | 0.01 |
| Si | 0.12 | 0.07 | 0.01 | 0.01 |
| Mo | 0.61 | 0.06 | 0.01 | 0.01 |
| Ti | <0.01 | <0.01 | 2.29 | 2.34 |
| Nb | 0.08 | <0.01 | 0.38 | 0.39 |
| Cu | 0.03 | 0.03 | 0.01 | 0.03 |
| Fe | Remainder | Remainder | R 56.24 | R 55.31 |
| Al | 0.02 | <0.01 | 0.35 | 0.31 |
| Mg | 0.0016 | <0.001 | 0.0005 | 0.0005 |
| Co | 0.02 | 0.02 | 0.01 | 0.01 |
| B | | | 0.0005 | 0.0005 |
| C | | | 0.003 | 0.003 |
| N | | | 0.002 | 0.002 |
| Zr | | | 0.003 | 0.002 |
| O | | | 0.004 | |
| S | | | 0.002 | 0.002 |
| P | | | 0.002 | 0.002 |
| Ca | 0.003 | 0.0003 | 0.0005 | 0.0005 |

Table 2 compares cobalt-containing laboratory melts to a Pernifer 36 alloy that belongs to the prior art.

TABLE 2

| Element | Alloy | | | | | | |
|---|---|---|---|---|---|---|---|
| | Pernifer 36 | Pernifer 37 TiCo HS | Pernifer 39 TiCo HS | Pernifer 40 TiCo HS | Pernifer 37 TihCo HS | Pernifer 39 TihCO HS | Pernifer 40 TihCO HS |
| | LB batch | | | | | | |
| (%) | 50576 | 1020 | 1021 | 1022 | 1023 | 1024 | 1025 |
| Cr | 0.20% | 0.01 | 0.1 | 0.01 | 0.01 | 0.01 | 0.01 |
| Ni | 36.31 | 37.28 | 36.46 | 40.54 | 37.01 | 38.54 | 40.15 |
| Mn | 0.12 | 0.01 | 0.01 | 0.01 | 0.01 | 0.01 | 0.01 |
| Si | 0.12 | 0.01 | 0.01 | 0.01 | 0.01 | 0.01 | 0.01 |
| Mo | 0.61 | 0.01 | 0.01 | 0.01 | 0.01 | 0.01 | 0.01 |
| Ti | <0.01 | 2.33 | 2.31 | 2.28 | 2.41 | 2.36 | 2.39 |
| Nb | 0.08 | 0.37 | 0.37 | 0.37 | 0.43 | 0.42 | 0.43 |
| Cu | 0.03 | 0.01 | 0.01 | 0.01 | 0.01 | 0.01 | 0.01 |
| Fe | Remainder | R 55.55 | R 54.3 | R 52.35 | R 54.83 | R 53.18 | R 51.57 |
| Al | 0.02 | 0.29 | 0.28 | 0.27 | 0.29 | 0.29 | 0.28 |
| Mg | 0.0016 | 0.0005 | 0.0005 | 0.0005 | 0.0005 | 0.0005 | 0.0005 |
| Co | 0.02 | 4.10 | 4.10 | 4.11 | 5.15 | 5.13 | 5.10 |
| B | | 0.0005 | 0.0006 | 0.0006 | 0.0005 | 0.0006 | 0.0006 |
| C | | 0.002 | 0.002 | 0.002 | 0.003 | 0.003 | 0.002 |
| N | | 0.002 | 0.002 | 0.002 | 0.002 | 0.002 | 0.002 |
| Zr | | 0.002 | 0.005 | 0.006 | 0.004 | 0.006 | 0.005 |
| O | | 0.004 | 0.004 | 0.004 | 0.003 | 0.005 | 0.005 |
| S | | 0.002 | 0.002 | 0.002 | 0.002 | 0.002 | 0.002 |
| P | | 0.002 | 0.002 | | 0.002 | 0.002 | 0.002 |
| Ca | 0.003 | 0.005 | 0.0005 | 0.0005 | 0.0006 | 0.0006 | 0.0006 |

Laboratory melts LB1018 through LB1025 were melted and cast in a block. The blocks were heat rolled to 12 mm sheet thickness. One half of each block was left at 12 mm and solution annealed. The second half was rolled further to 5.1 mm.

Tables 3/3a and 4/4a provide the mechanical properties of these two and also of the six laboratory batches compared to the two Pernifer comparison batches at room temperature.

Measured values for cold-rolled material, 4.1 to 4.2 mm in thickness, were found for both rolled and solution-annealed material and are presented in Table 3/3a. Starting from the heat-rolled material, each of the specimens that was heat rolled from the 12-mm sheets was cold rolled.

TABLE 3

| Mechanical properties (cobalt-free alloys) | | | | | |
|---|---|---|---|---|---|
| Batch | Rolled | $R_{p0.2}$ (MPa) | $R_m$ (MPa) | $A_{50}$ (%) | Hardness HRB |
| | Rolled | | | | |
| LB 1018 | Pernifer 40 Ti HS | 715 | 801 | 11 | 100 |
| LB 1019 | Pernifer 41 Ti HS | 743 | 813 | 11 | 101 |
| 151292 | Pernifer 36 Mo So 2 | 693 | 730 | 12 | 95 |
| 50576 | Pernifer 36 | 558 | 592 | 13 | 90 |
| | Solution annealed 1140° C./3 min | | | | |
| LB 1018 | Pernifer 40 Ti HS | 394 | 640 | 40 | 82 |
| LB 1019 | Pernifer 41 Ti HS | 366 | 619 | 40 | 85 |
| 151292 | Pernifer 36 Mo So 2 | 327 | 542 | 38 | 79 |
| 50576 | Pernifer 36 | 255 | 433 | 38 | 66 |

TABLE 3a

| Mechanical properties (cobalt-containing alloys) | | | | | |
|---|---|---|---|---|---|
| Batch | Rolled | $R_{p0.2}$ (MPa) | $R_m$ (MPa) | $A_{50}$ (%) | Hardness HRB |
| | Rolled | | | | |
| LB 1020 | Pernifer 37 TiCo HS | 762 | 819 | 11 | 100 |
| LB 1021 | Pernifer 39 TiCo HS | 801 | 813 | 12 | 98 |
| LB 1022 | Pernifer 40 TiCo HS | 782 | 801 | 13 | 98 |

TABLE 3a-continued

| Batch | Rolled | $R_{p0.2}$ (MPa) | $R_m$ (MPa) | $A_{50}$ (%) | Hardness HRB |
|---|---|---|---|---|---|
| Mechanical properties (cobalt-containing alloys) | | | | | |
| LB 1023 | Pernifer 37 TihCo HS | 719 | 790 | 12 | 98 |
| LB 1024 | Pernifer 39 TihCo HS | 727 | 801 | 13 | 99 |
| LB 1025 | Pernifer 40 TihCo HS | 706 | 781 | 15 | 97 |
| 151292 | Pernifer 36 Mo So 2 | 693 | 730 | 12 | 95 |
| 50576 | Pernifer 36 | 558 | 592 | 13 | 90 |
| Solution annealed at 1140° C./3 min | | | | | |
| LB 1020 | Pernifer 37 TiCo HS | 439 | 660 | 38 | 84 |
| LB 1021 | Pernifer 39 TiCo HS | 415 | 645 | 37 | 85 |
| LB 1022 | Pernifer 40 TiCo HS | 401 | 655 | 42 | 83 |
| LB 1023 | Pernifer 37 TihCo HS | 453 | 675 | 36 | 87 |
| LB 1024 | Pernifer 39 TihCo HS | 437 | 667 | 37 | 83 |
| LB 1025 | Pernifer 40 TihCo HS | 436 | 680 | 41 | 81 |
| 151292 | Pernifer 36 Mo So 2 | 327 | 542 | 38 | 79 |
| 50576 | Pernifer 36 | 255 | 433 | 38 | 66 |

The mechanical properties of the two or six laboratory batches, solution-annealed and cured, and cured only, are compared to Pernifer 36 at room temperature in Table 4/4a. Measured values were found for cold rolled specimens, 4.1 to 4.2 mm thick, rolled and solution-annealed. Proceeding from heat-rolled material, the specimens that were heat rolled from the 12-mm sheets were cold rolled.

TABLE 4

| Batch | Rolled | $R_{p0.2}$ (MPa) | $R_m$ (MPa) | $A_{50}$ (%) | Hardness HRB |
|---|---|---|---|---|---|
| Mechanical properties at room temperature (cobalt-free alloys) | | | | | |
| Cured at 732° C./1 hour | | | | | |
| LB 1018 | Pernifer 40 Ti HS | 1205 | 1299 | 3 | 113 |
| LB 1019 | Pernifer 41 Ti HS | 1197 | 1286 | 2 | 112 |
| 151292 | Pernifer 36 Mo So 2 | 510 | 640 | 23 | 91 |
| 50576 | Pernifer 36 | 269 | 453 | 40 | 73 |
| Solution annealed and cured at 1140° C./3 min + 732° C./1 hour | | | | | |
| LB 1018 | Pernifer 40 Ti HS | 869 | 1135 | 12 | 110 |
| LB 1019 | Pernifer 41 Ti HS | 901 | 1125 | 10 | 112 |
| 151292 | Pernifer 36 Mo So 2 | 319 | 539 | 38 | 77 |
| 50576 | Pernifer 36 | 242 | 427 | 43 | 65 |

TABLE 4a

| Batch | Rolled | $R_{p0.2}$ (MPa) | $R_m$ (MPa) | $A_{50}$ (%) | Hardness HRB |
|---|---|---|---|---|---|
| Mechanical properties at room temperature (cobalt-containing alloys) | | | | | |
| Cured 732° C./1 hour | | | | | |
| LB 1020 | Pernifer 37 TiCo HS | 1182 | 1304 | 4 | 114 |
| LB 1021 | Pernifer 39 TiCo HS | 1144 | 1257 | 3 | 111 |
| LB 1022 | Pernifer 40 TiCo HS | 1185 | 1290 | 3 | 111 |
| LB 1023 | Pernifer 37 TihCo HS | 1183 | 1308 | 6 | 112 |
| LB 1024 | Pernifer 39 TihCo HS | 1147 | 1248 | 4 | 111 |
| LB 1025 | Pernifer 40 TihCo HS | 1173 | 1277 | 3 | 114 |
| 151292 | Pernifer 36 Mo So 2 | 510 | 640 | 23 | 91 |
| 50576 | Pernifer 36 | 269 | 453 | 40 | 73 |
| Solution annealed at 1140° C./3 min | | | | | |
| LB 1020 | Pernifer 37 TiCo HS | 986 | 1180 | 12 | 111 |
| LB 1021 | Pernifer 39 TiCo HS | 946 | 1148 | 9 | 112 |
| LB 1022 | Pernifer 40 TiCo HS | 899 | 1133 | 11 | 111 |
| LB 1023 | Pernifer 37 TihCo HS | 980 | 1183 | 11 | 111 |
| LB 1024 | Pernifer 39 TihCo HS | 946 | 1155 | 9 | 110 |

TABLE 4a-continued

| Batch | Rolled | $R_{p0.2}$ (MPa) | $R_m$ (MPa) | $A_{50}$ (%) | Hardness HRB |
|---|---|---|---|---|---|
| Mechanical properties at room temperature (cobalt-containing alloys) | | | | | |
| LB 1025 | Pernifer 40 TihCo HS | 911 | 1148 | 11 | 111 |
| 151292 | Pernifer 36 Mo So 2 | 319 | 539 | 38 | 77 |
| 50576 | Pernifer 36 | 242 | 427 | 43 | 65 |

The mechanical properties of the two or six laboratory batches, solution-annealed (1140° C./3 min) and cured (732° C./6 hours, top; 600° C./16 hours, bottom) are compared to Pernifer 36 at room temperature in Table 5/5a. Measured values were found for cold rolled specimens, 4.1 to 4.2 mm thick, rolled and solution-annealed. Proceeding from heat-rolled material, the specimens that were heat rolled from the 12-mm sheets were cold rolled.

TABLE 5

| Batch | Rolled | $R_{p0.2}$ (MPa) | $R_m$ (MPa) | $A_{50}$ (%) | Hardness HRB |
|---|---|---|---|---|---|
| Mechanical properties at room temperature (cobalt-free alloys) | | | | | |
| Solution annealed and cured 1140° C./3 min + 732° C./6 hours/OK | | | | | |
| LB 1018 | Pernifer 40 Ti HS | 926 | 1152 | 12 | 111 |
| LB 1019 | Pernifer 41 Ti HS | 929 | 1142 | 12 | 112 |
| 151292 | Pernifer 36 Mo So 2 | 326 | 542 | 37 | 76 |
| 50576 | Pernifer 36 | 260 | 441 | 38 | 66 |
| Solution annealed and cured at 1140° C./3 min + 600° C./16 hours | | | | | |
| LB 1018 | Pernifer 40 Ti HS | 815 | 1007 | 20 | 105 |
| LB 1019 | Pernifer 41 Ti HS | 814 | 1031 | 18 | 106 |
| 151292 | Pernifer 36 Mo So 2 | 330 | 544 | 36 | 78 |
| 50576 | Pernifer 36 | 257 | 442 | 37 | 66 |

TABLE 5a

| Batch | Rolled | $R_{p0.2}$ (MPa) | $R_m$ (MPa) | $A_{50}$ (%) | Hardness HRB |
|---|---|---|---|---|---|
| Mechanical properties at room temperature (cobalt-containing alloys) | | | | | |
| Solution annealed and cured 1140° C./3 min + 732° C./6 hours/OK | | | | | |
| LB 1020 | Pernifer 37 TiCo HS | 949 | 1164 | 14 | 112 |
| LB 1021 | Pernifer 39 TiCo HS | 921 | 1141 | 13 | 110 |
| LB 1022 | Pernifer 40 TiCo HS | 916 | 1142 | 14 | 111 |
| LB 1023 | Pernifer 37 TihCo HS | 950 | 1179 | 14 | 111 |
| LB 1024 | Pernifer 39 TihCo HS | 927 | 1157 | 13 | 110 |
| LB 1025 | Pernifer 40 TihCo HS | 930 | 1151 | 12 | 111 |
| 151292 | Pernifer 36 Mo So 2 | 326 | 542 | 37 | 76 |
| 50576 | Pernifer 36 | 260 | 441 | 38 | 66 |
| Solution annealed and cured at 1140° C./3 min + 600° C./16 hours | | | | | |
| LB 1020 | Pernifer 37 TiCo HS | 905 | 1068 | 16 | 107 |
| LB 1021 | Pernifer 39 TiCo HS | 915 | 1075 | 13 | 107 |
| LB 1022 | Pernifer 40 TiCo HS | 871 | 1065 | 14 | 107 |
| LB 1023 | Pernifer 37 TihCo HS | 983 | 1125 | 13 | 107 |
| LB 1024 | Pernifer 39 TihCo HS | 939 | 1096 | 14 | 107 |
| LB 1025 | Pernifer 40 TihCo HS | 884 | 1060 | 15 | 105 |
| 151292 | Pernifer 36 Mo So 2 | 330 | 544 | 36 | 78 |
| 50576 | Pernifer 36 | 257 | 442 | 37 | 66 |

Table 6/6a provides mean thermal expansion coefficients (20 to 200° C.) in $10^{-6}$/K for the two or six laboratory batches compared to Pernifer 36 as follows:

A) heat-rolled, 12-mm thick sheet, solution annealed
B) heat-rolled, 12-mm thick sheet, solution annealed and cured 1 hour at 732° C.
C, D, E, F) heat-rolled to 5 mm (starting from 12 mm sheet), cold rolled to 4.15 mm
C) cured at 732° C./1 hour
D) solution annealed, 1140° C./3 min. and cured at 732° C./1 hour
E) solution annealed, 1140° C./3 min. and cured at 732° C./6 hours
F) solution annealed, 1140° C./3 min. and cured at 600° C./16 hours.

TABLE 6

| | | Sample | | | | | |
|---|---|---|---|---|---|---|---|
| | | 12 mm | 12 mm | 4.15 m | 4.15 m | 4.15 m | 4.15 |
| | | Condition | | | | | |
| Alloy | Batch | A | B | C | D | E | F |
| Pernifer 40 Ti HS | LB 1018 | 3.19 | 2.72 | 3.45 | 3.55 | 3.18 | 4.26 |
| Pernifer 41 Ti HS | LB 1019 | 3.48 | 3.11 | 3.01 | 2.98 | 3.63 | 3.43 |
| Pernifer 36 Mo So 2 | 151292 | | 1.6 | 1.97 | 1.98 | 2.03 | 2.13 |
| Pernifer 36 | 50576 | | 1.2 | 1.43 | 1.44 | 1.5 | 1.23 |

TABLE 6a

| | | Sample | | | | | |
|---|---|---|---|---|---|---|---|
| | | 12 mm | 12 mm | 4.15 m | 4.15 m | 4.15 m | 4.15 |
| | | Condition | | | | | |
| Alloy | Batch | A | B | C | D | E | F |
| Pernifer 37 TiCo HS | LB 1020 | 2.90 | 3.00 | 2.83 | 3.33 | 3.04 | 3.59 |
| Pernifer 39 TiCo HS | LB 1021 | 3.33 | 2.73 | 2.52 | 2.87 | 2.63 | 2.89 |
| Pernifer 40 TiCo HS | LB 1022 | 4.81 | 3.48 | 3.28 | 3.53 | 3.48 | 3.31 |
| Pernifer 37 TihCo HS | LB 1023 | 3.15 | 2.50 | 2.42 | 3.09 | 2.68 | 3.22 |
| Pernifer 39 TihCo HS | LB 1024 | 3.91 | 2.93 | 2.61 | 3.24 | 2.87 | 2.71 |
| Pernifer 40 TihCo HS | LB 1025 | 5.04 | 3.64 | 3.46 | 3.59 | 3.77 | 3.48 |
| Pernifer 36 Mo So 2 | 151292 | | 1.6 | 1.97 | 1.98 | 2.03 | 2.13 |
| Pernifer 36 | 50576 | | 1.2 | 1.43 | 1.44 | 1.5 | 1.23 |

Discussion of Results

A Cobalt-Free Alloys

When cold-rolled (Table 3, top), the yield point $R_{p0.2}$ is between 715 and 743 MPa for the LB batches. The tensile strength $R_m$ is between 801 and 813 MPa. The expansion values $A_{50}$ are 11%, and the hardness values HRB are between 100 and 101.

In contrast, the mechanical strength values are lower for Pernifer 36 Mo So 2 ($R_{p0.2}$=693 MPA, $R_m$=730 MPa), and are much lower for Pernifer 36 ($R_{p0.2}$=558 MPA, $R_m$=592%).

When solution-annealed (Table 3, bottom), the values for the yield point are between 366 and 394 MPa for the LB batches, and the tensile strengths Rn, are between 619 and 640 MPa. Expansion values are correspondingly higher and hardness values are correspondingly lower. The strength of Pernifer 36 Mo So 2 is lower when solution annealed ($R_{p0.2}$=327 MPA, $R_m$=542 MPa), and is much lower for Pernifer 36 ($R_{p0.2}$=255 MPA, $R_m$=433 MPa).

The highest strength values are attained when the LB batches are cured e.g. at 732° C./1 hour, having been previously rolled (i.e., without prior solution annealing) (Table 4, top). In this case the LB batches attain yield point values $R_{p0.2}$ of 1197 to 1205 MPa and for tensile strength $R_m$ values between 1286 and 1299 MPa. The expansion values are then only 2 to 3%. Hardness HRB increases to values of 111 to 113. When rolled and annealed in the same manner, the alloys Pernifer 36 Mo So 2 and Pernifer 36 have significantly lower strength values ($R_{p0.2}$=510 MPA and 269 MPa, respectively, and $R_m$=640 MPa and 453 MPa, respectively).

Since the solution-annealed condition is the suitable condition for molding sheet, the mechanical properties for "solution-annealed+cured" are relevant. Table 4, bottom, lists the associated values for thermal treatment of 1140° C./3 min+732° C./1 hour. In this case, the LB batches attain values for the yield point $R_{p0.2}$ of 896 to 901 MPa and tensile strengths $R_m$ between 1125 and 1135 MPa. When annealed like this, the alloys Pernifer 36 Mo So 2 and Pernifer 36 have much lower strength values.

Extending the annealing period to 6 hours for the thermal curing treatment at 732° C. changes the strength values (see Table 5, top) to ranges $R_{p0.2}$ from 926-929 MPa and tensile strengths $R_m$ between 1142 and 1152 MPa. In this case, as well, the comparison alloys have much lower strength values.

Reducing the annealing temperature to 600° C. for the thermal curing treatment with an annealing period of 16 hours in general reduces the strength values more for the LB batches, in particular the tensile strength $R_m$ (see Table 5, bottom).

Table 6 provides the values for the mean thermal expansion coefficients CTE (20-100° C.) for the investigated alloys as observed.

The chemical composition influences the Curie temperature and thus the buckling point temperature, above which the thermal expansion curve has a steeper incline.

FIG. 1 depicts the expansion coefficients (CTE) 20-100° C. and 20-200° C. for the LB batches in condition B (see Table 6), i.e., heat-rolled, 12-mm sheet, solution annealed+cured 1 hour at 732° C., as a function of the Ni content in the laboratory melt.

Batch LB 1018, having an Ni content of 40.65%, has a lower expansion coefficient than batch LB 1019, having an Ni content of 41.55%. A test melt having an even lower Ni content (Ni: 39.5%, Ti: 2.28%, Nb: 0.37%, Fe: remainder, Al: 0.32%) demonstrated that the optimum is attained with approximately 41% nickel. The optimum shifts to a somewhat higher Ni content (~41.5%) for the thermal expansion coefficient between 20° C. and 200° C.

B Cobalt-Containing Alloys

When rolled (Table 3a, top), the yield point $R_{p0.2}$ is between 706 and 801 MPa for LB batches. Batch LB 1025 has the lowest value, and batch LB 1021 has the highest value. The tensile strength $R_m$ is between 730 and 819 MPa (lowest value for LB 1025, highest value for LB 1020). The expansion values $A_{50}$ range between 11 and 15%, and the hardness values HRB range between 97 and 100.

In contrast, the mechanical strength values are lower for Pernifer 36 Mo So 2 ($R_{p0.2}$=693 MPA, $R_m$=730 MPa), and for Pernifer 36 are much lower ($R_{p0.2}$=558 MPA, $R_m$=592 MPa).

When solution annealed (Table 3a, bottom), the values for the yield point are between 401 and 453 MPa for the LB batches, and the tensile strengths $R_m$ are between 645 and 680 MPa. The expansion values are correspondingly higher and the hardness values are correspondingly lower. The strength of Pernifer 36 Mo So 2 is lower when solution annealed ($R_{p0.2}$=327 MPA, $R_m$=542 MPa), and is much lower for Pernifer 36 ($R_{p0.2}$=255 MPA, $R_m$=433 MPa).

The highest strength values can be attained when the LB batches are cured e.g. at 732° C./1 hour having been previously rolled (i.e., without prior solution annealing) (Table 4a, top). In this case the LB batches attain yield point values $R_{p0.2}$ of 1144 to 1185 MPa and for tensile strength $R_m$ values between 1248 and 1308 MPa. The expansion values are then only 3 to 6%. Hardness HRB increases to values of 111 to 114. When rolled and annealed in the same manner, the alloys Pernifer 36 Mo So 2 and Pernifer 36 have significantly lower strength values ($R_{p0.2}$=510 MPA and 269 MPa, respectively, and $R_m$=640 MPa and 453 MPa, respectively).

Since the solution-annealed condition is the suitable condition for molding sheet, the mechanical properties for "solution-annealed+cured" are relevant. Table 4a, bottom, lists the associated values for thermal treatment of 1140° C./3 min+732° C./1 hour. In this case, the LB batches attain values for the yield point $R_{p0.2}$ of 899 to 986 MPa and tensile strengths $R_m$ between 1133 and 1183 MPa. When annealed like this, the alloys Pernifer 36 Mo So 2 and Pernifer 36 have much lower strength values.

Extending the annealing period to 6 hours for the thermal curing treatment at 732° C. changes the strength values (see Table 5a, top) such that values attained for the yield point $R_{p0.2}$ are between 916-950 MPa and for tensile strengths $R_m$ are between 1142 and 1179 MPa.

Reducing the annealing temperature to 600° C. for the thermal curing treatment with an annealing period of 16 hours in general reduces the strength values more for the LB batches, in particular the tensile strength Rn, (see Table 5a, bottom).

Table 6a provides the values for the mean thermal expansion coefficients CTE (20-100° C.) for the investigated alloys as observed. E.g. LB1021 and LB1023 exhibit good values.

The chemical composition influences the Curie temperature and thus the buckling point temperature, above which the thermal expansion curve has a steeper incline.

Figure 2:
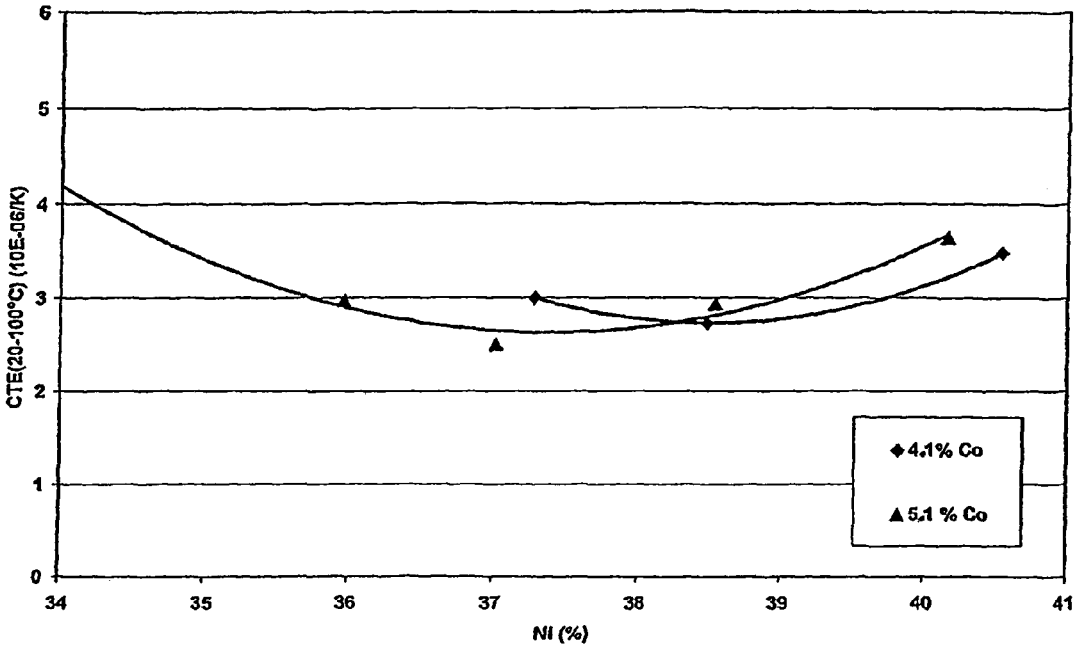
Figure 3:
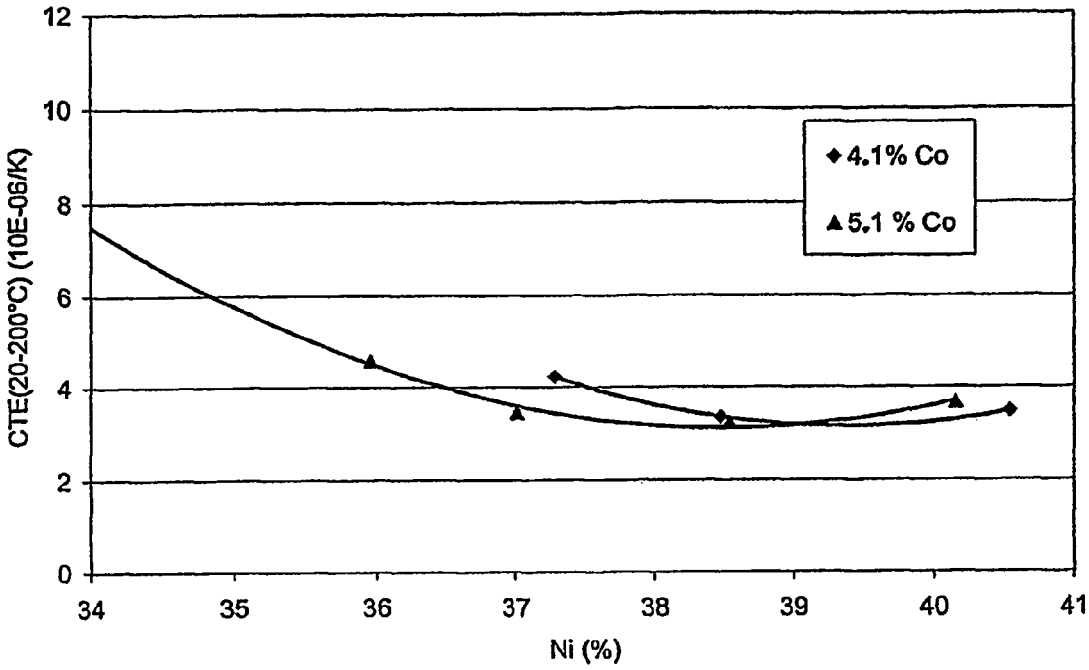

FIGS. 2 and 3 depict the expansion coefficients 20-100° C. (FIG. 2) and 20-200° C. (FIG. 3) for the 6 LB batches in the series with Co contents 4.1% and 5.1% in condition B (see Table 6a), i.e., heat-rolled, 12-mm sheet, solution annealed+cured 1 hour at 732° C., as a function of the Ni content in the laboratory melt.

In the series having 4.1% Co, there is a minimum expansion coefficient at about 38.5% Ni in the temperature range from 20 to 100° C., at 39.5% Ni in the temperature range 20-200° C. In the case of the series with 5.1% Co, the expansion coefficient drops for the three investigated LB batches as Ni content increases.

The temperature range 20-200° C. is particularly interesting for use in mold construction, because curing of the CFCs occurs at approximately 200° C. The differences in the thermal expansion coefficients between the 4% Co-containing alloys and the 5% Co-containing alloys is so minor that the alloys having the higher Co content cannot be justified for cost reasons.

The invention claimed is:

1. A method comprising fabricating a mold from materials comprising a creep-resistant and low-expansion iron-nickel alloy that has increased mechanical strength and producing an aircraft part of carbon fiber-reinforced composite in the mold, the alloy consisting essentially of, in % by weight,

| | |
|---|---|
| Ni | 37.0 to 40.5% |
| C | max. 0.1% |

-continued

| | |
|---|---|
| Ti | 2.0 to 3.0% |
| Al | 0.1 to 0.8% |
| Nb | 0.1 to 0.6% |
| Mn | 0.005 to 0.1% |
| Si | 0.005 to 0.1% |
| Co | >3.5 and <5.5 |

remainder Fe and impurities, the alloy satisfying the condition Ni+½ Co>38 and <43%;

the alloy having a mean thermal expansion coefficient of $<3.5\times10^{-6}$/K in a temperature range from 20 to 200° C., the alloy being solution annealed and cured to have a yield point of $R_{p0.2}$≥871 MPa-≤0.950 MPa and a tensile strength $R_m$≥1060 MPa-≤1179 MPa.

2. The method in accordance with claim 1, wherein the alloy from which the mold is fabricated comprises sheet material, strip material, or tube material.

3. The method in accordance with claim 1, wherein the alloy from which the mold is fabricated comprises wire and the fabricating of the mold comprises welding with the wire comprised of the alloy.

4. The method in accordance with claim 1, wherein only parts of the mold that are subject to mechanical loads higher than those to which other parts of the mold are subject are fabricated from the alloy.

5. The method in accordance with claim 1, wherein the alloy from which the mold is fabricated is in the form of forged stock.

6. The method in accordance with claim 1, wherein the alloy from which the mold is fabricated is in the form of cast stock.

7. The method in accordance with claim 1, the alloy consisting essentially of, in % by weight,

| | |
|---|---|
| Ni | 38.0 to 39.5% |
| C | 0.001 to 0.05% |
| Ti | 2.0 to 3.0% |
| Al | 0.1 to 0.7% |
| Nb | 0.1 to 0.6% |
| Mn | 0.005 to 0.1% |
| Si | 0.005 to 0.1% |
| Co | >4.0 and <5.5% |

remainder Fe and impurities, the alloy satisfying the condition Ni+½ Co>38.5 and <43%.

8. A method comprising fabricating a mold from materials comprising a creep-resistant and low-expansion iron-nickel alloy that has increased mechanical strength and producing an object of carbon fiber-reinforced composite in the mold, the alloy consisting essentially of, in % by weight,

| | |
|---|---|
| Ni | 37 to 41% |
| C | max. 0.1% |
| Ti | 2.0 to 3.5% |
| Al | 0.1 to 1.5% |
| Nb | 0.1 to 1.0% |
| Mn | 0.005 to 0.8% |
| Si | 0.005 to 0.6% |
| Co | 2.5 to 5.5% |

remainder Fe and impurities, the alloy satisfying the following condition:

Ni+½ Co>38 to <43.5%, the alloy having a mean thermal expansion coefficient of $<4\times10^{-6}$/K in a temperature range from 20 to 200° C.

9. The method in accordance with claim 1 or 8, wherein the alloy further comprises, in % by weight,

| | |
|---|---|
| Cr | max. 0.1% |
| Mo | max. 0.1% |
| Cu | max. 0.1% |
| Mg | max. 0.005% |
| B | max. 0.005% |
| N | max. 0.006% |
| O | max. 0.003% |
| S | max. 0.005% |
| P | max. 0.008% |
| Ca | max. 0.005%. |

10. The method in accordance with claim 8, the alloy consisting essentially of, in % by weight,

| | |
|---|---|
| Ni | 37.5 to 40.5% |
| C | max. 0.1% |
| Ti | 2.0 to 3.0% |
| Al | 0.1 to 0.8% |
| Nb | 0.1 to 0.6% |
| Mn | 0.005 to 0.1% |
| Si | 0.005 to 0.1% |
| Co | >3.5 to <5.5% |

remainder Fe and impurities, the alloy satisfying the condition Ni+½Co>38 and <43%, and has a mean thermal expansion coefficient of $<3.5\times10^{-6}$/K in a temperature range from 20 to 200° C.

11. The method in accordance with claim 10, the alloy consisting essentially of, in % by weight,

| | |
|---|---|
| Ni | 38.0 to 39.5% |
| C | 0.001 to 0.05% |
| Ti | 2.0 to 3.0% |
| Al | 0.1 to 0.7% |
| Nb | 0.1 to 0.6% |
| Mn | 0.005 to 0.1% |
| Si | 0.005 to 0.1% |
| Co | >4.0 to <5.5% |

remainder Fe and impurities, the alloy satisfying the condition Ni+½ Co>38.5 and <43%.

12. The method in accordance with claim 10 or 11, wherein the alloy is provided with the following maximum contents of the following elements, in % by weight,

| | |
|---|---|
| Cr | max. 0.1% |
| Mo | max. 0.1% |
| Cu | max. 0.1% |
| Mg | max. 0.005% |
| B | max. 0.005% |
| N | max. 0.006% |
| O | max. 0.003% |
| S | max. 0.005% |
| P | max. 0.008% |
| Ca | max. 0.005%. |

13. A method comprising fabricating a mold from materials comprising a creep-resistant and low-expansion iron-nickel alloy that has increased mechanical strength and producing an object of carbon fiber-reinforced composite in the mold, the alloy consisting essentially of, in % by weight,

| | |
|---|---|
| Ni | 38.0 to 39.0% |
| C | 0.001 to 0.02% |
| Ti | 2.0 to 2.5% |
| Al | 0.1 to 0.45% |
| Nb | 0.1 to 0.45% |
| Mn | 0.005 to 0.05% |
| Si | 0.005 to 0.5% |
| Co | >4.0 to <5.5% |

remainder Fe and impurities, the alloy satisfying the condition

Ni+½ Co>40.0 and <42.0%, and has a mean thermal expansion coefficient of $<3.2\times10^{-6}$/K in a temperature range from 20 to 200° C.

14. The method in accordance with claim 13, wherein said mean thermal expansion coefficient is $<3.0\times10^{-6}$/K.

* * * * *